US011840380B2

(12) United States Patent
Wassum et al.

(10) Patent No.: US 11,840,380 B2
(45) Date of Patent: Dec. 12, 2023

(54) RESEALABLE POURING ELEMENT FOR CARDBOARD/PLASTIC COMPOSITE PACKAGES WITH A TAMPER-EVIDENT SEAL TO INDICATE THE INITIAL OPENING

(71) Applicant: SIG Technology AG, Neuhausen am Rheinfall (CH)

(72) Inventors: Markus Wassum, Buch (CH); David Koller, Fislisbach (CH); Hansjörg Huber, Radolfzell (DE)

(73) Assignee: SIG Technology AG, Neuhausen am Rheinfall (NL)

( * ) Notice: Subject to any disclaimer, the term of this patent is extended or adjusted under 35 U.S.C. 154(b) by 0 days.

(21) Appl. No.: 17/772,922

(22) PCT Filed: Oct. 13, 2020

(86) PCT No.: PCT/EP2020/078735
§ 371 (c)(1),
(2) Date: Apr. 28, 2022

(87) PCT Pub. No.: WO2021/104736
PCT Pub. Date: Jun. 3, 2021

(65) Prior Publication Data

US 2022/0371772 A1 Nov. 24, 2022

(30) Foreign Application Priority Data

Nov. 29, 2019 (DE) ..... 10 2019 132 538.2

(51) Int. Cl.
*B65D 5/74* (2006.01)
*B65D 41/34* (2006.01)

(52) U.S. Cl.
CPC ..... *B65D 5/748* (2013.01); *B65D 41/3409* (2013.01); *B65D 2401/15* (2020.05)

(58) Field of Classification Search
CPC ..... B65D 5/748; B65D 41/3409; B65D 2401/15; B65D 5/747; B65D 55/16; B65D 55/024; B65D 2401/30
See application file for complete search history.

(56) References Cited

U.S. PATENT DOCUMENTS 5,482,176 A 1/1996 Maietta et al.
6,474,491 B1 11/2002 Benoit-Gonin et al.
(Continued)

FOREIGN PATENT DOCUMENTS

DE 60024772 T2 8/2006
DE 102006016113 B3 8/2007
(Continued)

*Primary Examiner* — Shawn M Braden
(74) *Attorney, Agent, or Firm* — THE WEBB LAW FIRM

(57) ABSTRACT

Represented and described is a resealable pouring element for cardboard/plastic composite packages, in particular beverage packages, with a base element having a circumferential fastening flange as well as an external thread, with opening means arranged at least in the unopened state of the pouring element in the interior of the base element and with a screw cap with internal thread, wherein the opening means are designed such that when the composite package is initially opened by unscrewing the screw cap by breaking the composite material of the package or a barrier layer located in the base element, a pour opening is created inside the pouring element and wherein at least one tamper-evident seal is arranged between the base element and the screw cap. In order to reduce the assembly effort for such a resealable pouring element, it is provided that an anchor ring is arranged below the screw cap and is connected to the screw cap via a hinge a rotationally fixed manner and in that the tamper-evident seal consists of an indicating element, whose one end is fixedly connected to the anchor ring or the screw cap and in which the other end is connected to the anchor
(Continued)

ring by means of a predetermined breaking point in such manner that the predetermined breaking point of at least one mandrel element arranged on the fastening flange is broken when the screw cap is unscrewed and thus indicates to the consumer that an initial opening has already taken place.

18 Claims, 3 Drawing Sheets

(56) References Cited

U.S. PATENT DOCUMENTS

| | | | | |
|---|---|---|---|---|
| 8,672,167 | B2 | 3/2014 | Leuenberger et al. | |
| 10,513,377 | B2 * | 12/2019 | Lenz | B65D 43/169 |
| 2009/0302037 | A1 | 12/2009 | Rigling | |

FOREIGN PATENT DOCUMENTS

| | | | | |
|---|---|---|---|---|
| DE | 102007057863 | A1 | 6/2009 | |
| DE | 102015110526 | B4 * | 8/2018 | B65D 5/746 |
| FR | 2785264 | A1 | 5/2000 | |
| MU | 91006309 | U2 | 5/2013 | |
| WO | 2008002249 | A1 | 1/2008 | |
| WO | 2017001162 | A1 | 1/2017 | |

* cited by examiner

RESEALABLE POURING ELEMENT FOR CARDBOARD/PLASTIC COMPOSITE PACKAGES WITH A TAMPER-EVIDENT SEAL TO INDICATE THE INITIAL OPENING

CROSS-REFERENCE TO RELATED APPLICATIONS

This application is the United States national phase of International Application No. PCT/EP2020/078735 filed Oct. 13, 2020, and claims priority to German Patent Application No. 10 2019 132 538.2 filed Nov. 29, 2019, the disclosures of which are hereby incorporated by reference in their entirety.

BACKGROUND OF THE INVENTION

Field of the Invention

The invention relates to a resealable pouring element for cardboard/plastic composite packages, in particular beverage packages, with a base element having a circumferential fastening flange as well as an external thread, with opening means arranged at least in the unopened state of the pouring element in the interior of the base element and with a screw cap with internal thread, wherein the opening means are designed such that when the composite package is initially opened by unscrewing the screw cap by breaking the composite material of the package or a barrier layer located in the base element, a pour opening is created inside the pouring element and wherein at least one tamper-evident seal is arranged between the base element and the screw cap.

Description of Related Art

A generic pouring element is known from DE 10 2006 016 113 B3 attributable to the applicant. To assemble the pouring element, the screw cap is moved over the cutting element protruding from the pouring element and pressed (pushed) together with it onto the base element. As a tamper-evident seal, a plate is moulded onto the screw cap in one piece, which is connected to the screw cap via connecting bridges. For connection with the base element, the plate has pins on its underside, which engage into corresponding recesses of the flange of the base element and are caulked from below after assembly.

To implement the tamper-evident seal, this known pouring element therefore requires, on the one hand, a relatively large amount of space for receiving the plate on the fastening flange and, on the other hand, the work step for caulking in order to be able to establish the form-fitting or materially-bonded connection between the plate and the fastening flange. Furthermore, a self-opening and resealable pouring element made of plastic is already known from DE 10 2007 057 863 A1 for application on a package for liquids, in which a screw cap is fastened to the base element of the pouring element via a fastening flange. This fastening flange also serves as a tamper-evident seal and tears when the screw cap is opened initially.

Pouring elements are also known which have a plate or flap inside the base element which act as a barrier layer and enable a pour opening when the composite package is initially opened, driven by the screw cap, by removing or folding away into the inside of the package (DE 600 24 772 T2).

Furthermore, pouring elements are known (WO 2008/002249 A1), in which indicating elements for signalling an already initial opening are arranged directly in the lower region of the screw cap. This is also known from U.S. Pat. No. 5,482,176 A, in which a ring produced in one piece with the screw cap is used as a tamper-evident seal, which shears off when the screw cap is initially opened and remains as an indicating element on the base of the base element.

SUMMARY OF THE INVENTION

Based on this, the object of the present invention is now to design and further develop a resealable pouring element of the type mentioned at the outset such that the assembly effort is reduced.

The object is achieved in that an anchor ring is arranged below the screw cap and is connected to the screw cap via a hinge in a rotationally fixed manner and in that the tamper-evident seal consists of an indicating element, whose one end is fixedly connected to the anchor ring and in which the other end is connected to the anchor ring or screw cap by means of a predetermined breaking point in such manner that the predetermined breaking point of at least one mandrel element arranged on the fastening flange is broken when the screw cap is unscrewed and thus indicates to the consumer that an initial opening has already taken place.

The invention has recognized that a fixed connection between the tamper-evident seal and the fastening flange is not absolutely necessary, since the arrangement, according to the invention, of the elements required for the tamper-evident seal reliably fulfils the function of the tamper-evident seal, even without the indicating element being connected to the fastening flange or to the mandrel element arranged thereon in a positive-locking or materially-bonded manner.

A further teaching of the invention provides that the anchor ring is freely and radially rotatable around the base element and connected to the base element in a tension-resistant manner in the axial direction. Such a configuration of the invention ensures that, even after the initial opening of the screw cap in the screwed-on state, it remains connected to the anchor ring arranged on the base element in a tension-resistant manner via a suitable element, such as for example a hinge. Loose plastic parts are therefore reliably avoided even when the package is open. The pouring element according to the invention can be freely rotated with the screw cap open and unfolded. However, a certain frictional resistance acting in the circumferential direction is desired in order to be able to turn the opened screw cap in one direction during pouring so that the pouring stream is not obstructed.

In another preferred embodiment of the invention, the anchor ring has at least one cam on its upper side, which is arranged in the region of the indicating element, has an oblique surface and engages into a corresponding recess of the lower edge of the screw cap. Due to the surface of the cam running obliquely in the circumferential direction, the anchor ring is pressed in the direction of the fastening flange when it is initially opened, so that the predetermined breaking points present between the anchor ring and the screw cap are reliably broken.

A further teaching of the invention provides that the predetermined breaking point of the indicating element is arranged in the screw-on direction of the screw cap before the fixed connection with the anchor ring. This is expedient if the dimension and arrangement of the indicating element are adapted to the mandrel element such that reliable destruction of the predetermined breaking point is associated with screwing on.

However, it is also possible to arrange the predetermined breaking point of the indicating element in the screw-on direction of the screw cap behind the fixed connection with the anchor ring. Another alternative can also be configured in such manner that the indicating element is designed as a radially projecting loop and that the predetermined breaking point of the indicating element is arranged on the fixed connection with the anchor ring. In this configuration, the loop of the indicating element expediently encloses the mandrel element on the fastening flange before the pouring element is initially opened.

According to another preferred teaching of the invention, a membrane is provided as a predetermined breaking point of the indicating element. In such a configuration, the membrane is completely or largely destroyed such that the indicating element directly indicates the initial opening of such a pouring element to the consumer.

According to a further configuration of the invention, the mandrel element is arranged radially outside of the anchor ring on the fastening flange. For this purpose, an internal bead can also be designed circumferentially on the anchor ring. This design increases the stability of the entire construction, of the anchor ring and also the pulling forces. However, if a higher assembly height is not a problem, it is also possible to alternatively arrange the mandrel element below the anchor ring on the fastening flange.

Since, in particular in the case of pouring elements provided with a cutting element as an opening means, the cutting element cuts very steeply into the package material during the initial opening, it is particularly expedient if, in a further configuration of the invention, the indicating element and the mandrel element are aligned to one another in an unopened position such that the predetermined breaking point of the mandrel element already breaks at an angle of rotation of 3° to 10°, preferably at an angle of rotation of 5° to 7°, when the screw cap is screwed on.

A different configuration of the invention provides that the predetermined breaking point breaks when the screw cap is screwed on at a torque of >0.2 Nm.

In a further embodiment of the invention, it is provided that the predetermined breaking point is broken inside the base element when the screw cap is screwed on before the composite package is actually initially opened or before the barrier layer is broken. This means that even the smallest manipulations on the screw cap can be reliably indicated.

A further teaching of the invention provides that the lower cut between the anchor ring and the screw cap is higher than the upper end of the indicating element. This cut indicates the gap between the anchor ring and the screw cap below the hinge between the two elements.

A further preferred configuration of the invention provides that the indicating element is arranged opposite the hinge in relation to the circumference of the screw cap. This configuration reliably ensures that the functions of the indicating element and of the hinge do not interfere with each other.

Finally, the pouring element according to the invention with its special configuration of the tamper-evident seal can also be used as transport protection.

An exemplary embodiment of the present invention is represented in the following drawing.

BRIEF DESCRIPTION OF THE DRAWINGS

The Drawing Shows

DESCRIPTION OF THE INVENTION

Figure 1:
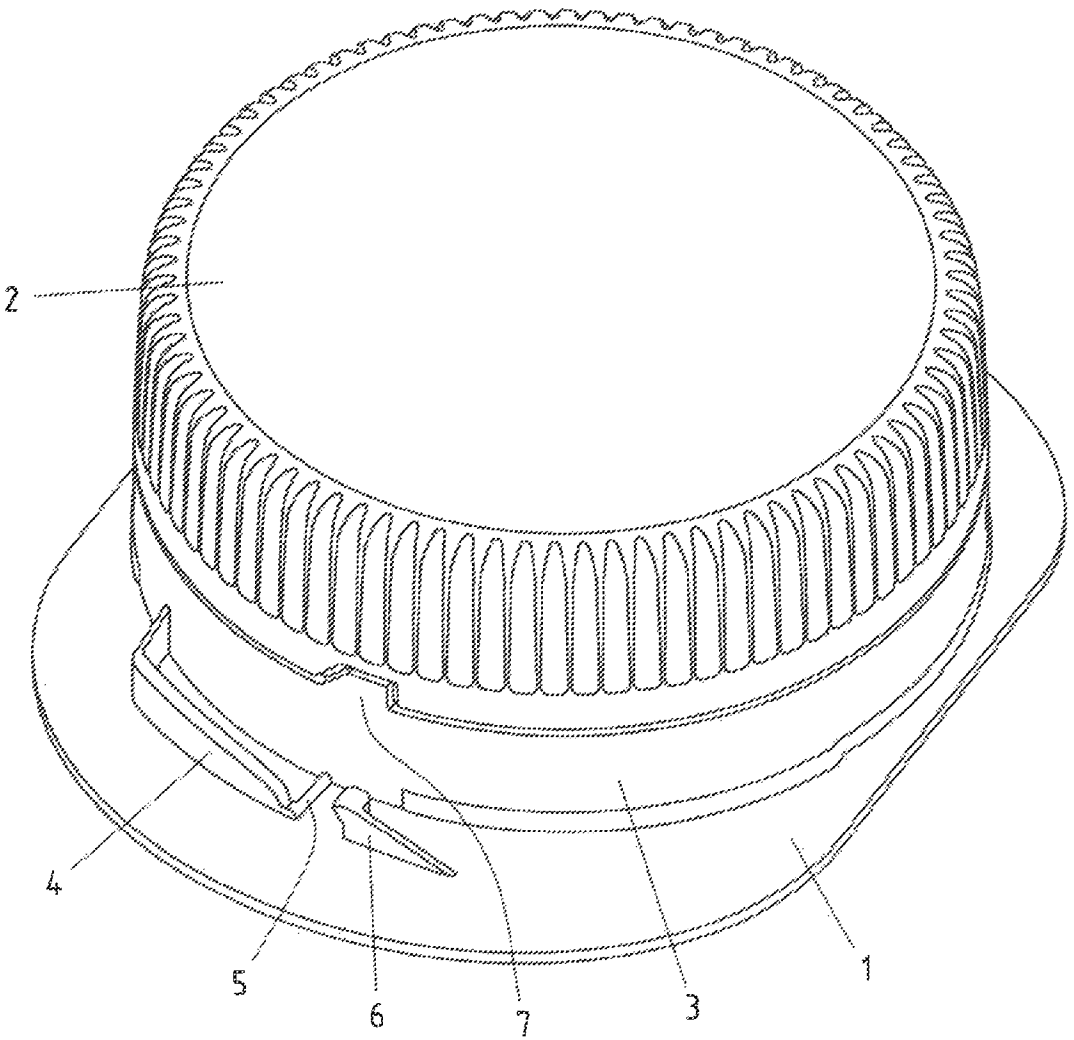
FIG. 1 a perspective representation of a pouring element according to the invention in an assembled state (without cardboard/plastic composite package), FIG. 2 the pouring element from FIG. 1 at the start of the screw-on process of the screw cap and FIG. 3 the pouring element from FIG. 1 with screw cap screwed on even further in another perspective representation.

FIG. 1 clearly shows the circumferential fastening flange 1 of the (concealed) base element and a screw cap 2, which is used for the initial opening and for the resealing of the package (not represented) after its initial opening. An anchor ring 3 is arranged below the screw cap 2 and is connected to it in a rotationally fixed manner in order to reliably prevent the screw cap 2 from being removed from the pouring element or a beverage package provided with it. For this purpose, screw cap 2 and anchor ring 3 are connected to each other in a hinged manner.

According to the invention, an indicating element 4 is used as a tamper-evident seal, whose one end is fixedly connected to the anchor ring 3 and in which the other end is connected to the anchor ring 3 by means of a predetermined breaking point 5 in such manner that the predetermined breaking point 5 is broken by a mandrel element 6 arranged on the fastening flange 1 when the screw cap 2 is screwed on. In the unopened assembled position according to FIG. 1, a certain distance can be seen between the predetermined breaking point 5 and the mandrel element 6.

Figure 2:
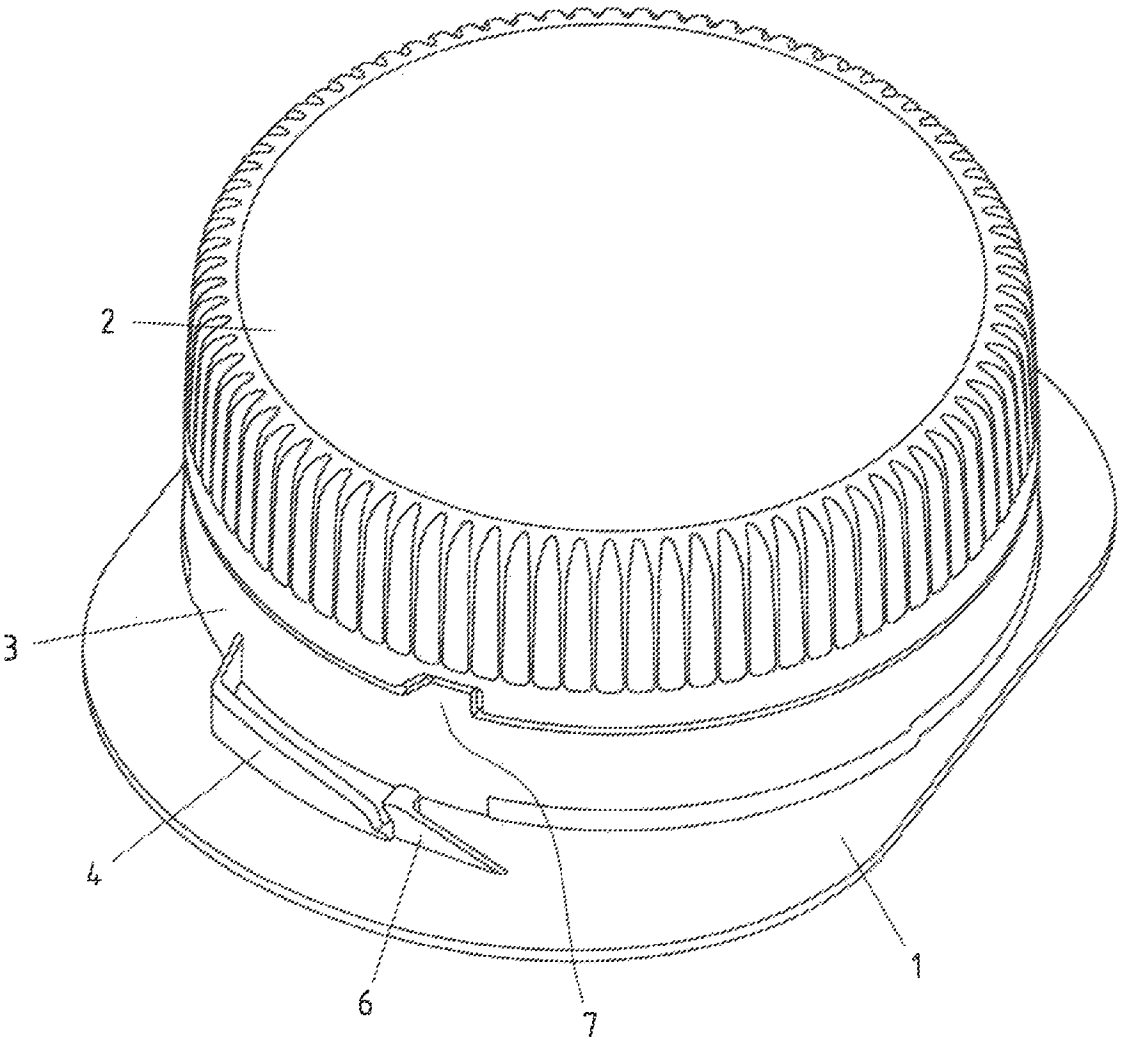

FIG. 2 now shows the pouring element from FIG. 1 after a slight rotation during the screw-on process. In this case, the predetermined breaking point 5 (no longer discernible in the figure) already strikes the mandrel element 6. It is clear that screwing the screw cap 2 on further leads to the mandrel element 6 shearing off the predetermined breaking point 5 and thus releasing the leading end of the indicating element 4 from the anchor ring 3.

Figure 3:
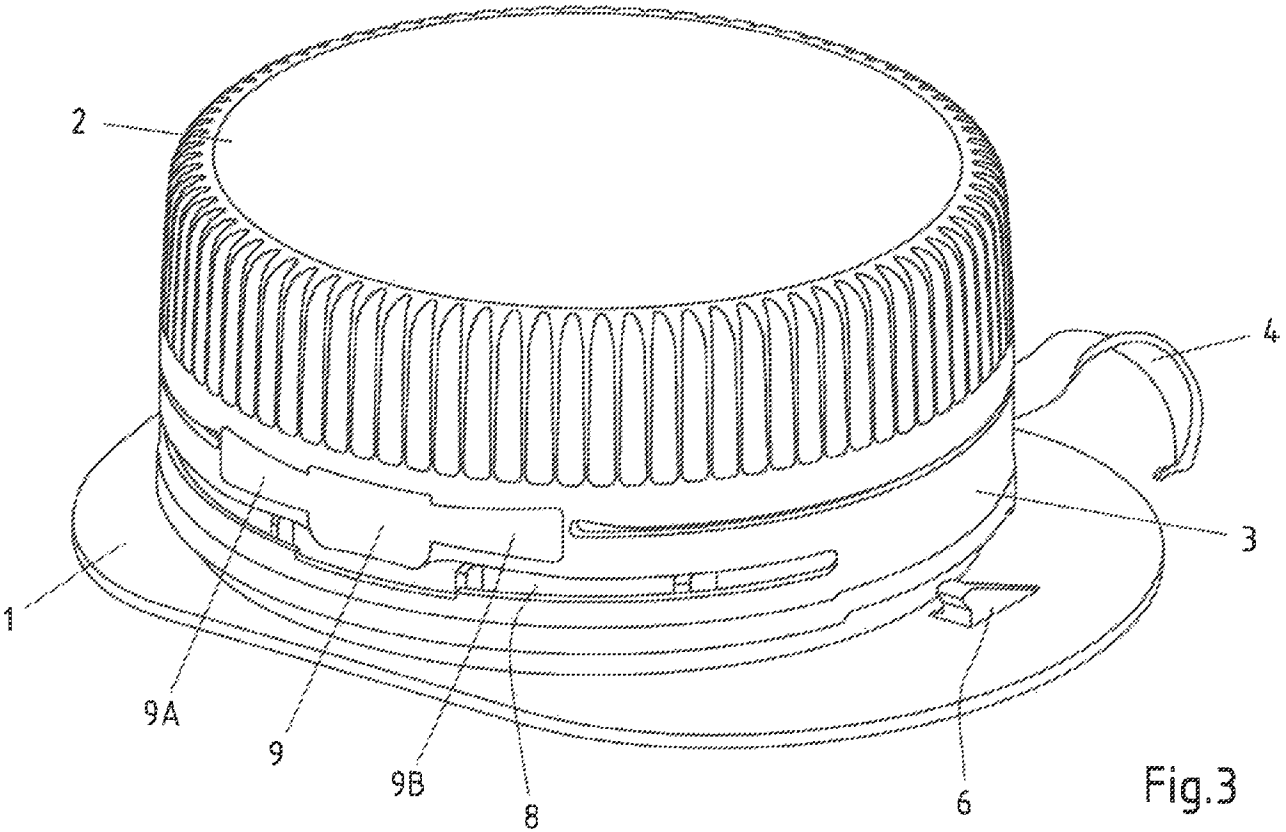

When the screw cap 2 is screwed on further, the screw cap 2, together with the anchor ring 3, slowly rises according to the pitch of the external thread (not represented) on the base element 8 or of the corresponding internal thread of the screw cap 2, as is represented in FIG. 3. The strip-like indicating element 4 is only connected in one piece with the anchor ring 3 at its fixed connection.

In the representation according to FIG. 3, in addition to the elements already mentioned, the type of hinged connection between screw cap 2 and anchor ring 3 can also be seen, which is designed as a hinge 9 in the exemplary embodiment represented and preferred in this respect. In the exemplary embodiment represented, the hinge 9 has a reinforcing element 9A or 9B on each side. This design ensures a fixed connection between screw cap 2 and anchor ring 3 so that tearing the screw cap 2 off the anchor ring 3 is reliably prevented.

Finally, FIG. 3 also shows that the indicating element 4 is arranged opposite the hinge 9 in relation to the circumference of the screw cap 2.

The configuration according to the invention allows a simpler assembly of the resealable pouring element without the indicating element 4 serving as a tamper-evident seal having to be connected to the fastening flange 1 in a positive-locking or materially-bonded manner.

The invention claimed is:

1. A resealable pouring element for cardboard/plastic composite packages, in particular beverage packages, with a base element having a circumferential fastening flange as well as an external thread, with opening means arranged at least in an unopened state of the pouring element in an interior of the base element and with a screw cap with internal thread, wherein the opening means are designed such that when a composite package is initially opened by unscrewing the screw cap, the opening means breaks a composite material of the package or a barrier layer located in the base element, a pour opening is created inside the pouring element and wherein at least one tamper-evident seal is arranged between the base element and the screw cap, wherein an anchor ring is arranged below the screw cap and is connected to the screw cap via a hinge in a rotationally fixed manner and in that the tamper-evident seal consists of an indicating element, whose one end is fixedly connected to the anchor ring or the screw cap and in which the other end is connected to the anchor ring by means of a predetermined breaking point in such manner that the predetermined breaking point of at least one mandrel element arranged on the fastening flange is broken when the screw cap is unscrewed and thus indicates to the consumer that an initial opening has already taken place.

2. A pouring element according to claim 1, wherein the anchor ring is freely and radially rotatable around the base element and is connected to the base element in a tension-resistant manner in an axial direction.

3. The pouring element according to claim 1, wherein the anchor ring has at least one cam on its upper side, which is arranged in the region of the indicating element, has an oblique surface and engages into a corresponding recess of the lower edge of the screw cap.

4. The pouring element according to claim 1, wherein the predetermined breaking point of the indicating element is arranged in the screw-off direction of the screw cap before the fixed connection with the anchor ring.

5. The pouring element according to claim 1, wherein the predetermined breaking point of the indicating element is arranged in the screw-off direction of the screw cap behind the fixed connection with the anchor ring.

6. The pouring element according to claim 1, wherein the indicating element is designed as a radially projecting loop and in that the predetermined breaking point of the indicating element is arranged on the fixed connection with the anchor ring.

7. The pouring element according to claim 6, wherein the loop encloses the mandrel element on the fastening flange before the initial opening.

8. The pouring element according to claim 1, wherein a membrane is provided as a predetermined breaking point of the indicating element.

9. The pouring element according to claim 1, wherein the mandrel element is arranged radially outside the anchor ring on the fastening flange.

10. The pouring element according to claim 1, wherein an internal bead is designed circumferentially on the anchor ring.

11. The pouring element according to claim 1, wherein the mandrel element is arranged below the anchor ring on the fastening flange.

12. The pouring element according to claim 1, wherein the indicating element and the mandrel element are aligned with one another in an unopened position such that the predetermined breaking point of the mandrel element is broken after an angle of rotation of 3° to 10° when the screw cap is screwed on.

13. The pouring element according to claim 12, wherein the predetermined breaking point of the mandrel element is broken after an angle of rotation of 5° to 7° when the screw cap is screwed on.

14. The pouring element according to claim 1, wherein the predetermined breaking point breaks when the screw cap is screwed on at a torque of >0.2 Nm.

15. The pouring element according to claim 1, wherein the predetermined breaking point is broken when the screw cap is screwed on before the composite package is initially opened or before the barrier layer is broken.

16. The pouring element according to claim 1, wherein the lower cut between the anchor ring and the screw cap is higher than the upper end of the indicating element.

17. The pouring element according to claim 1, wherein the indicating element is arranged opposite the hinge in relation to the circumference of the screw cap.

18. The pouring element according to claim 1, wherein at least one tamper-evident seal is used as transport protection.

* * * * *